US007353915B2

(12) United States Patent
Zaharia et al.

(10) Patent No.: US 7,353,915 B2
(45) Date of Patent: Apr. 8, 2008

(54) AUTOMATIC DESTINATION ENTRY SYSTEM WITH OVERRIDE CAPABILITY

(75) Inventors: Vlad Zaharia, Rocky Hill, CT (US); Wade Montague, Southington, CT (US); Richard Mangini, Brookfield, CT (US); Gary Meguerdichian, Farmington, CT (US); Richard K. Pulling, Jr., Avon, CT (US); Paul Stranieri, Bristol, CT (US)

(73) Assignee: Otis Elevator Company, Farmington, CT (US)

( * ) Notice: Subject to any disclaimer, the term of this patent is extended or adjusted under 35 U.S.C. 154(b) by 632 days.

(21) Appl. No.: 10/951,094

(22) Filed: Sep. 27, 2004

(65) Prior Publication Data

US 2006/0065490 A1 Mar. 30, 2006

(51) Int. Cl.
*B66B 1/16* (2006.01)

(52) U.S. Cl. ..... 187/388; 187/391; 187/396

(58) Field of Classification Search ..... 187/380–388, 187/391–396
See application file for complete search history.

(56) References Cited

U.S. PATENT DOCUMENTS 4,673,911 A * 6/1987 Yoshida ..... 187/380
4,685,538 A 8/1987 Kamaike
4,691,808 A 9/1987 Nowak et al.
4,979,594 A * 12/1990 Begle et al. ..... 187/380
5,400,722 A 3/1995 Moses et al.
5,679,934 A 10/1997 Juntunen et al.
5,689,094 A 11/1997 Friedli et al.
5,952,626 A 9/1999 Zaharia
5,984,051 A 11/1999 Morgan et al.
6,109,396 A 8/2000 Sirag et al.
6,202,799 B1 * 3/2001 Drop ..... 187/388
6,315,083 B1 11/2001 Schuster et al.
6,382,363 B1 5/2002 Friedli
6,397,976 B1 6/2002 Hale et al.

FOREIGN PATENT DOCUMENTS

DE 3731773 C1 5/1989
GB 2241090 B 2/1994
WO WO9515050 6/1995

* cited by examiner

*Primary Examiner*—Jonathan Salata
(74) *Attorney, Agent, or Firm*—Carlson, Gaskey & Olds

(57) ABSTRACT

An elevator system (20) utilizes destination entry dispatching techniques. A controller (28) receives an automated destination request that includes a prestored, primary destination. This allows for seamlessly integrating building access and destination entry for the elevator system. A passenger interface (40) allows a passenger to override a prestored destination. The elevator controller (28) allows for override or secondary destination requests to be made at various intervals between receipt of the initial request and arrival of an initially assigned car at an appropriate level to let the passenger board the elevator car.

11 Claims, 2 Drawing Sheets

AUTOMATIC DESTINATION ENTRY SYSTEM WITH OVERRIDE CAPABILITY

FIELD OF THE INVENTION

This invention generally relates to elevator systems. More particularly, this invention relates to making elevator car assignments in a destination entry elevator dispatching system.

DESCRIPTION OF THE RELATED ART

Elevator systems are in widespread use throughout the world. Various system configurations and strategies are known for controlling passenger traffic and efficiently operating an elevator system.

Traditionally, hall call buttons allowed passengers to place a call to go up or down within a building and then to select a destination floor from a car operating panel located within an elevator car. While such arrangements are useful for many situations, elevator systems within larger buildings that handle more traffic volume have been shown to benefit from other control techniques. One example technique is known as destination entry.

In a destination entry system, a passenger provides a desired destination using a destination entry device outside of an elevator car. A controller then uses known techniques for assigning that passenger's travel to a particular elevator car. The destination entry device typically is located a fixed distance from the location of the elevator car. Various techniques for directing passengers to the appropriate car are known.

More recently, destination entry systems have been proposed that include prestored destinations that are communicated to the elevator system controller in an at least somewhat automated fashion. For example, it has been proposed to provide an individual with a building access card that they use to enter or access a building space. That card may include a prestored, preferred destination that is communicated to the elevator system controller when the individual uses the card to gain access to the building space. Such arrangements can increase the efficiency of handling traffic into a building space and onto an elevator system.

One shortcoming associated with such an arrangement is that traveling to a different floor other than the prestored destination requires an individual to locate the elevator group serving the appropriate floor and then use a destination entry device at that location to enter a request different than the prestored request. Under such circumstances, that individual does not benefit from the efficiencies otherwise available from that system. Moreover, the elevator system does not operate as efficiently because a car is needlessly dispatched to service the undesired, prestored destination.

There is a need for an arrangement that addresses a situation where an individual desires to travel to a floor other than a prestored, primary destination floor. It would be beneficial to have such an arrangement that can be seamlessly integrated into a building access (i.e., security) system. This invention addresses those needs.

SUMMARY OF THE INVENTION

An exemplary disclosed system for managing elevator traffic includes a controller that responds to a destination request that includes a preset, primary destination. The controller overrides the primary destination request responsive to a secondary destination request.

In one example, the controller receives the destination request from a device that reads a building access card, for example. That device also provides an indication to the controller of the preset, primary destination. In that example, the control of the elevator system can be seamlessly integrated with the building access or security system.

In one example, an interface allows a passenger to select a secondary destination. The controller assigns a car responsive to the secondary destination request in place of assigning a car to the primary destination request. In one example, the interface is located in the immediate vicinity of the building access device that includes the receiver of the preset, primary destination request. In one example, the interface that allows the passenger to place the secondary destination request is located near the exit of a turnstile that provides an individual access to the building space.

In one example, the controller continues to monitor for an override destination request until an assigned car is dispatched to the appropriate level for a passenger to board the elevator. When an override request is received, the controller cancels the earlier car assignment and makes a car assignment appropriately responsive to the later-entered request.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
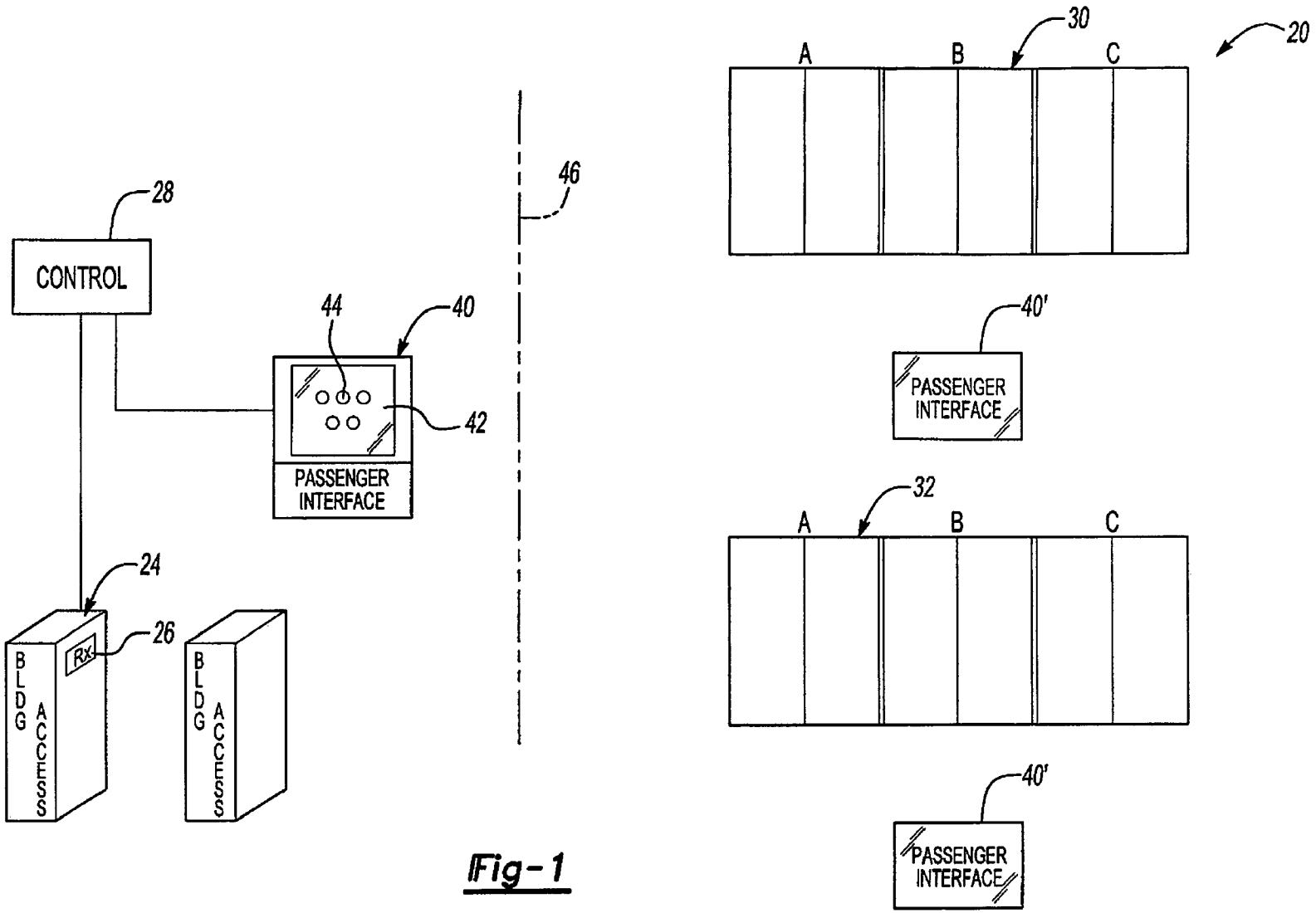
FIG. 1 schematically illustrates selected portions of an elevator system designed according to an embodiment of this invention.

FIG. 1 schematically shows portions of an elevator system 20. A building access device 24 such as a turnstile allows an individual to gain access to a building space. An input receiver device 26 is associated with the building access device 24 for receiving credential verification to allow an individual to access the building space. In one example, the input receiver device 26 comprises a card reader. Other known devices such as radio frequency transceivers, fingerprint recognition devices, voice recognition devices or electronic key readers, may be used. Those skilled in the art who have the benefit of this description will realize which devices will meet the needs of their particular situation. For purposes of discussion, an access card will be used as the example device for providing credential verification to gain access to the building space.

The input receiver device 26 also receives an indication of a preset, primary destination to which the individual will be carried by the elevator system 20. The input receiver device functions as a destination entry device that does not require manual input from any individual to identify their desired destination. The example arrangement facilitates seamless integration of a building access system and a destination entry elevator dispatching system.

A controller 28 receives the automated destination request and eventually assigns an elevator car to service that request. In the example of FIG. 1, elevator groups 30 and 32 each include a plurality of cars A, B and C. The controller 28 assigns a particular car to service each request. Known techniques for making such assignments are used in one example.

It is possible that one or more individuals on any given day will prefer to travel to a building level or destination that is different than the preset, primary destination associated with their building access card. The illustrated arrangement accommodates such a situation by allowing an individual to make a modification to the destination request in an efficient manner. A passenger interface 40 preferably is positioned near the building access device 24. In one example, the passenger interface 40 is near the exit from a turnstile that provides entrance to the building space. The passenger interface 40 allows an individual to override the primary, prestored destination so that the controller 28 assigns a car to carry them to a different destination. In the example of FIG. 1, the passenger interface 40 includes a touch screen display 42 that presents various options 44 to allow an individual to override the primary, prestored destination.

In one example, an individual's access card will include identification information. A database relates the identification information to the primary, prestored destination and a plurality of authorized secondary destinations. In such an example, the display 42 shows options for the primary destination, the secondary destinations or both. In some examples, the primary destination is always displayed to provide the individual with confirmation that their automated destination request was entered.

In another example, multiple primary destinations may be prestored and the individual may need to use the passenger interface 40 to select one of those so that the controller 28 knows which destination is the desired destination. In such an example, at least one of the primary destinations is set as a default destination in the event that the individual cannot or does not enter a choice on the passenger interface 40.

In one example where a plurality of primary destinations are prestored, the passenger interface 40 displays each of them in a manner that is recognizable by the individual. For example, different floor numbers may be presented. In some situations, for security reasons, the alternatives available to that individual may be labeled in a manner that is recognized by that individual but would not necessarily be understood by somebody else who could see the display screen 42 of the interface 40.

In another example, hot buttons are presented on the display screen 42 for popular alternative destinations such as a building cafeteria or exercise facility.

In another example, the passenger interface 40 comprises a display and does not receive passenger input. The interfaces 40', which may be located on destination entry kiosks, allow an individual to use the same building access card to place an override request. This example arrangement may be most useful, for example, in buildings where the distance between the building access device 24 and the entrances to the elevator cars is relatively short. One advantage to such an arrangement is that the passenger interface 40 may be less expensive than one that allows for passenger input at that location.

One example controller 28 waits a preselected time (five seconds in one example) for an individual to enter a secondary or overriding destination request using the passenger interface 40. If that time expires without the individual making such a request, the controller 28 proceeds with assigning a car to service the preset, primary destination. If an individual enters a secondary destination request, the controller 28 assigns a car to service that request.

In one example, the controller 28 does not make the car assignment until after a preselected time period that allows an individual to make a secondary request has expired. In another example, the controller 28 assigns a car to travel to the primary, prestored destination responsive to receipt of the initial request at the device 26 and there is no preset waiting time to watch for a secondary destination request.

The controller 28 also monitors for an override request that a passenger would enter using the interface 40 or another passenger interface 40', which in the illustrated example is located near the entrances to the elevator cars. The dashed line 46 schematically illustrates a fixed distance between the building access device and the entrances to the elevator cars. The illustrated example provides an individual the ability to override a primary destination request immediately after passing through the building access device 24 or at a later time when near an elevator group. In either event, the controller 28 acknowledges the override request by making an appropriate car assignment.

Figure 2:
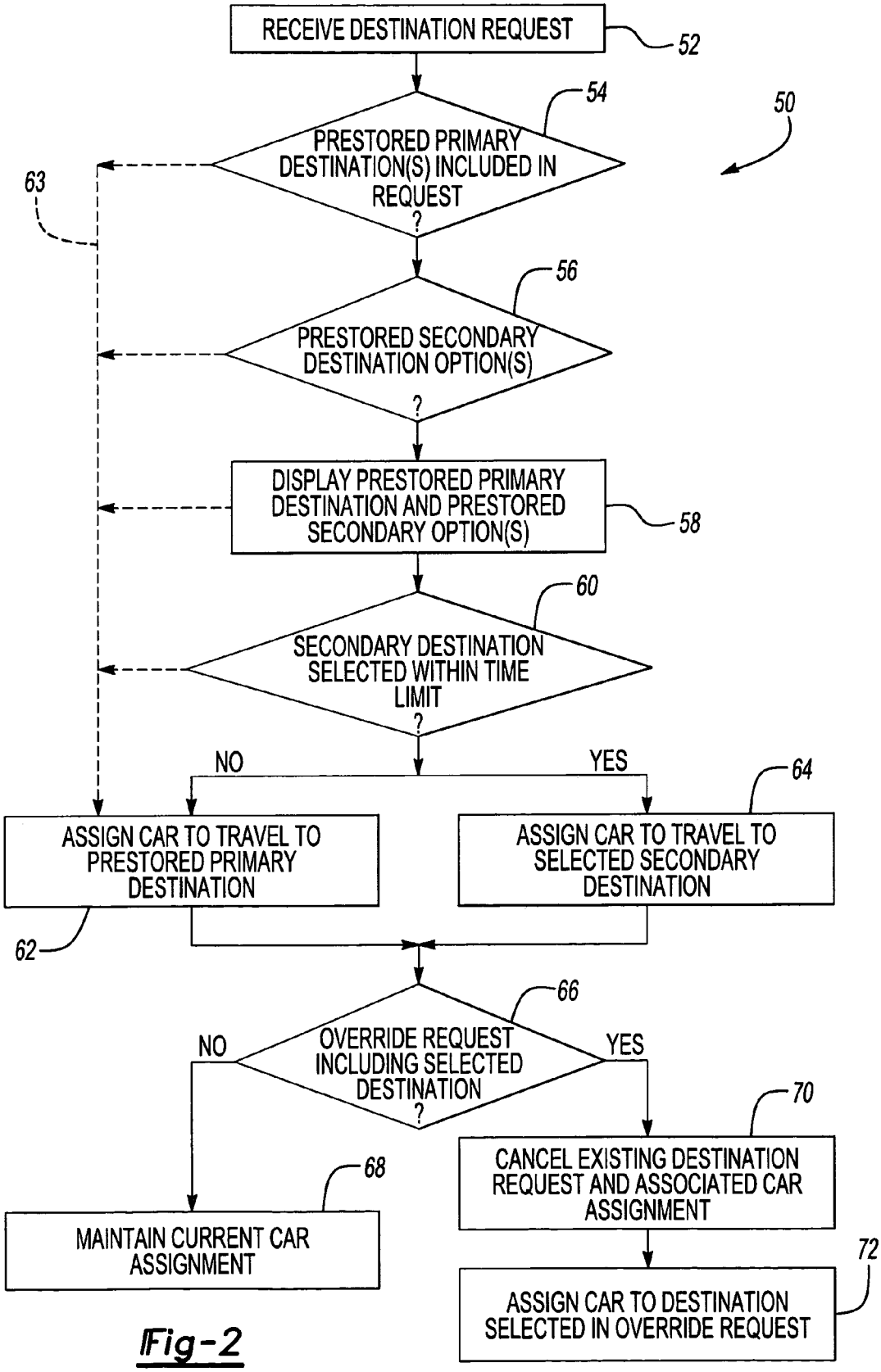
FIG. 2 is a flowchart diagram summarizing an example control strategy.

FIG. 2 includes a flowchart diagram 50 that summarizes one control strategy that is useful with the example of FIG. 1. The automated destination request including the preset, primary destination is received at 52 by the input receiver device 26. The controller 28 determines whether a prestored, primary destination is included in the request at 54. The controller 28 in the illustrated example also determines at 56 whether there are any prestored, secondary destination options. This may occur when an individual has access to only selected floors within a building, for example.

At 58, the controller causes the interface 40 to display the primary destination from the received request and to display any prestored other options such as secondary options or alternative primary destinations.

The controller 28 waits a preselected time to see whether an individual will place a request different than the prestored, primary destination of the automated request at 60. If no secondary request is made, then the controller 28 assigns a car to travel to the prestored, primary destination at 62. In the example of FIG. 2, the dashed lines 63 show alternative times when the controller 28 may make an initial car assignment.

At 64, the controller 28 assigns an elevator car to travel to a secondary destination if one is selected.

After making the appropriate car assignment, the controller 28 in this example continues to monitor for an override request at 66. In one example, this process continues after making a car assignment until the assigned car arrives at the appropriate level to allow the passenger to board the elevator car. In one example, an override request is recognized by the controller 28 only when the same building access device (i.e., an access card) provides an identification of the individual so that the request can be correlated with a previous request made by that individual whether automated, by manual override or selection of a secondary destination. When an override request is made, the controller 28 cancels the existing destination request and the associated car assignment at 70. A new car assignment is made at 72.

The disclosed arrangement allows an individual to make an initial destination request for an elevator system to use destination entry dispatching techniques in a manner that can be seamlessly integrated into a building access or security system. The disclosed arrangement also handles alternative selections made by an individual or override selections while still maintaining the seamless integration feature.

Another advantage to the disclosed arrangement is that it eliminates unnecessary car dispatches by assigning an elevator car to travel to a destination responsive to an individual's daily preferences even though an automated preset, primary destination entry occurs upon an individual entering a building, for example. The disclosed example may operate in parallel with a destination entry system that receives requests in a known manner from destination entry devices near an elevator entrance, for example.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

What is claimed is:

1. A system for managing elevator traffic, comprising:

a building access device that allows an individual to gain access to a building space;

an input receiver device associated with the building access device for receiving credential verification to allow an individual to access the building space and for receiving an indication of a preset, primary destination;

a passenger interface positioned near the building access device; and a controller that is responsive to the destination request that includes the preset, primary destination, the controller assigns an elevator car to travel to a secondary destination responsive to a secondary destination selection made at the passenger interface, the controller otherwise assigns a car to travel to the primary destination.

2. The system of claim 1, wherein the passenger interface provides an indication of the primary destination from the destination request.

3. The system of claim 2, wherein there are a plurality of primary destinations, the interface indicates the plurality of primary destinations and the controller assigns the car to travel to a selected one of the indicated primary destinations responsive to a selection made by an individual.

4. The system of claim 2, wherein the destination request includes at least one preset, secondary destination, the interface provides an indication of the secondary destination and the controller assigns the car to travel to a selected one of the primary destination or the secondary destination.

5. The system of claim 2, wherein the input receiving device receives identification information associated with the destination request that includes the preset, primary destination, the input receiving device being positioned to be encountered by an elevator passenger prior to the passenger encountering the passenger interface.

6. The system of claim 1, wherein the input receiving device is integrated with the building access device.

7. The system of claim 1, wherein the passenger interface is positioned in the vicinity of the initial input receiving device and remotely from the elevator car and including at least one other interface positioned in the vicinity of the elevator car, the controller being responsive to a destination request made at either one of the interfaces.

8. The system of claim 1, wherein the controller associates the destination request with a passenger identifier and the controller requires an indication of the passenger identifier at the passenger interface to change the car assignment or the destination.

9. The system of claim 1, wherein the controller makes an initial car assignment to travel to the primary destination responsive to the destination request and then overrides the initial car assignment responsive to a destination request made subsequent to the initial car assignment.

10. The system of claim 1, wherein the input receiver device is supported on the building access device.

11. The system of claim 1, wherein the passenger interface is positioned near an exit from the building access device.

* * * * *